US005913654A

United States Patent [19]

Kaup

[11] Patent Number: 5,913,654

[45] Date of Patent: Jun. 22, 1999

[54] LATERAL SHIFTING SYSTEM FOR FLOOR TRANSPORT VEHICLES

[75] Inventor: Otmar Kaup, Aschaffenburg, Germany

[73] Assignee: Kaup GmbH & Co. KG Gesellschaft fur, Aschaffenburg, Germany

[21] Appl. No.: 08/786,399

[22] Filed: Jan. 17, 1997

[30] Foreign Application Priority Data

Jan. 20, 1996 [DE] Germany ..... 196 02 055

[51] Int. Cl.[6] ..... B66F 9/14

[52] U.S. Cl. ..... 414/667

[58] Field of Search ..... 414/667, 671, 414/662, 663, 664, 785

[56] References Cited

U.S. PATENT DOCUMENTS

| | | | |
|---|---|---|---|
| 2,822,101 | 2/1958 | Schenkelberger . | |
| 3,819,078 | 6/1974 | Walsh | 414/671 |
| 4,125,199 | 11/1978 | Abels et al. . | |
| 4,165,008 | 8/1979 | Faust et al. | 414/667 X |
| 4,406,575 | 9/1983 | Gaibler | 414/667 |
| 4,607,997 | 8/1986 | Asano | 414/671 X |
| 4,902,190 | 2/1990 | House | 414/671 X |
| 5,147,171 | 9/1992 | Murray et al. | 414/671 |
| 5,190,436 | 3/1993 | Sorlie | 414/671 X |
| 5,217,343 | 6/1993 | Bostad et al. | 414/667 |
| 5,368,435 | 11/1994 | Bostad et al. | 414/667 |
| 5,707,201 | 1/1998 | Hamlik | 414/671 X |

FOREIGN PATENT DOCUMENTS

| | | | |
|---|---|---|---|
| 2306931 | 11/1976 | France | 414/667 |
| 2437374 | 4/1980 | France . | |
| 2339431 | 2/1975 | Germany . | |
| 2716704 | 10/1978 | Germany | 414/667 |
| 2716668 | 10/1985 | Germany . | |
| 0033245 | 3/1977 | Japan | 414/671 |
| 5221600 | 8/1993 | Japan | 414/667 |
| 5301700 | 11/1993 | Japan | 414/667 |
| 2007186 | 5/1979 | United Kingdom . | |
| 2099787 | 12/1982 | United Kingdom . | |

OTHER PUBLICATIONS

Dialog database record for DE 2716668.

Dialog database record for FR 2437374.

KAUP GmbH & Co KG Sales Brochure: "Freisicht–Seitenschieber T 151 P2 and T 151 P3 Freisicht–Seitenschieber integriert Freisicht–Mehrfach–Seitenschieber T 152/T 153/T 154" (1994).

*Primary Examiner*—James W. Keenan

*Attorney, Agent, or Firm*—Fulbright & Jaworski, LLP.

[57] ABSTRACT

Disclosed is a lateral shifting system for a floor transport vehicle, which has a lift carriage with a base frame with one upper and one lower hook edge for mounting fork tines and has a lateral shift frame. The lateral shift frame has two horizontal frame members with, on the one hand, cross sections which grasp the edges of the base frame and on the other hand form edges for fork tines, and a double-acting hydraulic driver for shifting the lateral shift frame. To reduce weight, tolerances and difficulty in assembly, the lower horizontal frame member can be swung in back of the bottom edge of the base frame by means of an uptumed cross-sectional extremity, and for a sliding, form-fitting combination of base frame and lateral shift frame, U-shaped antifriction bearings are inserted from the side between the lower edge of the base frame and the lower horizontal member of the lateral shift frame.

21 Claims, 7 Drawing Sheets

LATERAL SHIFTING SYSTEM FOR FLOOR TRANSPORT VEHICLES

BACKGROUND OF THE INVENTION

The invention relates to a lateral shifting system for floor transport vehicles, especially for fork lift trucks, which have a lift carriage with a basic frame having an upper and lower rail for mounting the fork tines, while on the upper rail, secured against transverse shifting, there is placed a first hooked frame member to which a hydraulic jack is attached and on which a lateral shifting frame can be turned back on its upper horizontal frame member against the direction of travel and can be shifted by the hydraulic drive across the direction of travel, and wherein a lower horizontal frame member of the lateral shifting frame can be joined to the lower rail so as to be displaceable across the direction of travel.

Such lateral shifting frames serve to compensate moving or positioning errors on the part of the driver of the floor transport vehicle in picking up and/or letting down a load, by means of the transverse displacement of a load pickup device which hereinbelow shall be referred to as fork tines considered as being representative also of types of load pickup devices other than forks. The transverse motion can amount to about 15 to 20 centimeters on either side of a central position, although this dimension is not critical. Without an adjuster the driver error would have to be compensated by repetitively moving the vehicle backward and forward.

The lateral shifting systems are therefore inserted between the base frame of a lift carriage on the side of the truck and the fork tines and for this purpose they have a lateral shift frame whose upper and lower edges coincide in position with those of the base frame, so that the fork tines can be placed either on the base frame of the lift carriage or on the lateral shift frame. The geometrical form and the spacing of the edges are standard, as a rule.

Such lateral shifters are disclosed by DE 27 16 668 C2 and the applicant's brochure "Freisicht-Seitenschieber T 151 P2 and T 151 P3" available since 1994.

The base frame, sometimes referred to as the base plate, has upper and lower horizontal frame members whose vertical dimensions amount as a rule to a multiple of their thickness. Strengthening is provided by vertical frame members and by fastening to the lift carriage. As shown in DE 27 16 668 C2, the cross section of at least the lower horizontal frame member of the lateral shift frame is at least similar to the horizontal frame member of the base frame. Thus the lateral shift flame, which is subject to flexure and twist, is heavy, and the known horizontal frame members also hamper the driver's view, inasmuch as in the known systems the hydraulic actuator necessary for transverse movement additionally obstructs the driver's view. A view of the load being carried, however, is essential to the driver for reasons of safety as well.

It is also apparent from the commercial brochure referred to above that the upper and lower horizontal frame members of the lateral shift frame are at least geometrically similar to those of the base frame. The upper horizontal frame member is bolted to two separate and vertically spaced hydraulic jacks whose confronting plungers act upon an abutment fixedly disposed on the base frame, so that the lateral shift frame is displaceable crosswise together with the hydraulic jacks. This known solution is also difficult to manufacture and it is very heavy in weight, which is undesirable inasmuch as the shifter frame increases the so-called "front-end bulk" and, due to its weight, places an additional load on the front axle of the vehicle. Moreover, in this solution the driver's view is restricted.

GB 2 099 787 A, U.S. Pat. No. 5,368,435 and FR 24 37 374 U have disclosed placing on the base frame of a lift carriage first a mounting frame member with a cylindrical outer surface, and then an upper horizontal frame member of a lateral shift frame, provided with a cylindrical inside surface, the cylindrical surfaces forming a joint and a displacement track. Various means are provided to block any upswing of the lateral shift frame. In all cases the hydraulic actuators are articulately connected and have also only one piston rod.

The apparatus according to GB 2099787 A has on the lower horizontal frame member two hooks which can rotate on blocks and which have to be secured by pins after they are turned to the locking position. Both of the horizontal frame members have massive cross sections, and the cylindrical inside surface of the upper horizontal frame member is part of a channel frame member which is welded on. Manufacture is complex and the weight is great.

In U.S. Pat. No. 5,368,435 only the upper horizontal frame member is made in a weight-saving manner, and the lock against upswing is provided by hooks which are vertically adjustable between L-shaped projections and can be locked down by set screws. This increases the distance between the base frame and the lateral shift frame. This patent also discloses slide blocks of plastic, but they are held by the L-shaped projections and an additional angle frame member and therefore cannot be inserted from the side. Mounting and dismounting are accordingly difficult.

In FR 2 437 374 U the two horizontal frame members of the lateral shift frame have equally massive cross sections similar to those of the base frame. The lock against upswing of the lateral shift frame consists of two L-shaped angles, each with a claw screwed to it. This also undesirably increases the distance between the two frames and thus the lever arm. Moreover, the view through the two frames is greatly restricted.

GB 2 007 186 A and DE 23 39 431 A1 do not disclose any definite pivot for the placement of the lateral shift frame on the basic frame of the lift carriage.

The apparatus of GB 2 007 186 A has an additional frame intermediate between the base frame and the lateral shift frame, which bears a hydraulic actuator. Thus, the distance between the base frame and the lateral shift frame becomes especially great. Furthermore, two projecting L-shaped guide rails are mounted on the intermediate frame, and the lateral shift frame has two additional projecting L-shaped guide rails in an arrangement complementary thereto. Two hooks serve to secure against upswing of the intermediate frame from the base frame, the guides of which run through the entire height of the intermediate frame and have to be locked by pins. The lateral shift frame anyway can be pushed onto the intermediate frame only from the side, which is difficult on account of the tendency to tip over. This arrangement has an especially unfavorable weight, and the driver's view is almost completely blocked.

Although DE 23 39 431 A1 discloses a lateral shift frame with two horizontal frame members, the latter do have a small cross sectional area in the shape of an "h" and a low weight, and this lowers resistance to flexure, which is a disadvantage in the rough usage which floor transport vehicles experience. The lateral shift frame can be mounted on the base frame only from the side. The vertical frame members of the lateral shift frame are behind the base frame, so that either their length of movement is limited or the distance between the frame members of the base frame has to be too great. Furthermore, the driver's view is substantially obstructed.

SUMMARY OF THE INVENTION

The present invention provides an improved lateral shift system of the kind described above. In the lateral shift system of the invention the number of parts, the production and assembly expense and the need for precision, the front size and the weight, are all reduced.

The object of the invention is obtained in the lateral shift system of the invention in that a) the lower horizontal frame member of the lateral shift frame has a permanently attached, upwardly directed cross-sectional end which can be set behind the bottom edge of the base frame, b) and that for the positive locking of the base frame and lateral shift frame against swinging movement of the lateral shift frame on its upper horizontal frame member in the direction of travel, U-shaped antifriction blocks are inserted from the lateral ends of the lower horizontal frame member between the bottom edge of the base frame and the bottom horizontal frame member of the lateral shift frame, and locked against the latter.

The stated problem is thus completely solved and especially the assembly is facilitated and simplified. After the hook frame member is set in place with the hydraulic actuator and lateral shift frame, the latter drops into its working position by gravity. The antifriction blocks may then be inserted from the sides and fastened. The apparatus is thus ready to operate. To a large extent, the substantial amount of manipulation from underneath the lateral shift frame is eliminated or minimized. The number of parts is reduced and hence the weight and the so-called front size, i.e., the lengthening of the vehicle, is reduced to a minimum. The lateral shift system according to the invention consists of an assembly of prefabricated machine parts allowing one to prepare different sizes of lateral shift systems by varying the lengths of the individual frame members.

It is especially advantageous if the lateral shift frame has two vertical frame members between its horizontal frame members, and if the hydraulic actuator has two oppositely driven plungers whose outer ends engage the inside surfaces of the vertical frame members.

It is not necessary in this case to bolt the plungers to the lateral shift frame, since no tension is produced on the plungers and the driven plunger pushes into the cylinder the plunger that is not under pressure.

As discussed below, assembly of the shift system is greatly simplified in contrast to the state of the art in which the lateral shift frame is joined to the base frame by metal antifriction blocks which have to be screwed to the lateral shift frame from the back, i.e., from a very unfavorable position. This advantageous solution, however, is also to be seen in contrast to the state of the art in which the complete lateral shift frame has to be pushed onto the base frame from the side.

Also, it is especially advantageous if the upper edge of the upturned cross-sectional end of the lower horizontal frame member is disposed below a horizontal plane defined by the bottom edge of the downwardly turned cross-sectional end of the same horizontal frame member.

In this manner,the mounting on the bottom edge of the base frame can be performed especially simply and with an accurate fit at a given position of the bottom edge of the lateral shift frame.

It is furthermore advantageous, then, if the horizontal frame members of the lateral shift frame have a substantially S-shaped cross section, and are disposed at least partially in mirror image symmetry with a horizontal central plane (E—E) of the lateral shift frame such that the cross-sectional extremities are aimed at one another and hook onto the edges of the base frame so as to be horizontally displaceable, and the other cross-sectional extremities are aimed away from one another and form edges on which fork tines can be hung.

The configuration and arrangement of the two horizontal frame members and vertical frame members according to the invention increase their moment of resistance in the horizontal, diagonal and vertical direction and at the same time reduce weight.

Al-in-all the stated problem is thereby solved to the full extent, and both the number of parts and the complexity of production and assembly are reduced while maintaining minimal tolerances and at the same time increasing the driver's field of view.

It is especially advantageous if the cross sections of the horizontal frame members are circumscribed each by a rectangle R1 and R2, respectively, whose height H1 and H2 is less than their width B1 and B2. In spite of the reduction of the height dimensions H1 and H2, moments of resistance in all conceivable directions are produced which permit heavy loading. Even so, for a given spacing of the horizontal frame members, the driver has a good view of the load.

In a further embodiment of the invention it is especially advantageous if the hydraulic actuator is disposed on a hooking frame member which has a greater length than the length of the cylindrical body of the hydraulic actuator when the hooking frame member is held securely against transverse displacement on the upper edge of the base frame, and if the upper horizontal frame member of the lateral shift frame is mounted displaceably on the hooking frame member, preferably with the interposition of a corresponding antifriction pad.

In one embodiment, the hooking frame member and the cylinder body are formed as an integral casting. In another embodiment, the cylinder body is formed from an oblong steel block and is joined rigidly by welding to a hooking frame member bent from sheet metal The rigid combination of hooking frame member and cylinder body supports the upper horizontal frame member of the lateral shift frame over a substantial portion of its length, so that any possible sagging of the upper horizontal frame member is additionally reduced.

The various features of novelty which characterizes the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF PREFERRED EMBODIMENT

Figure 1:
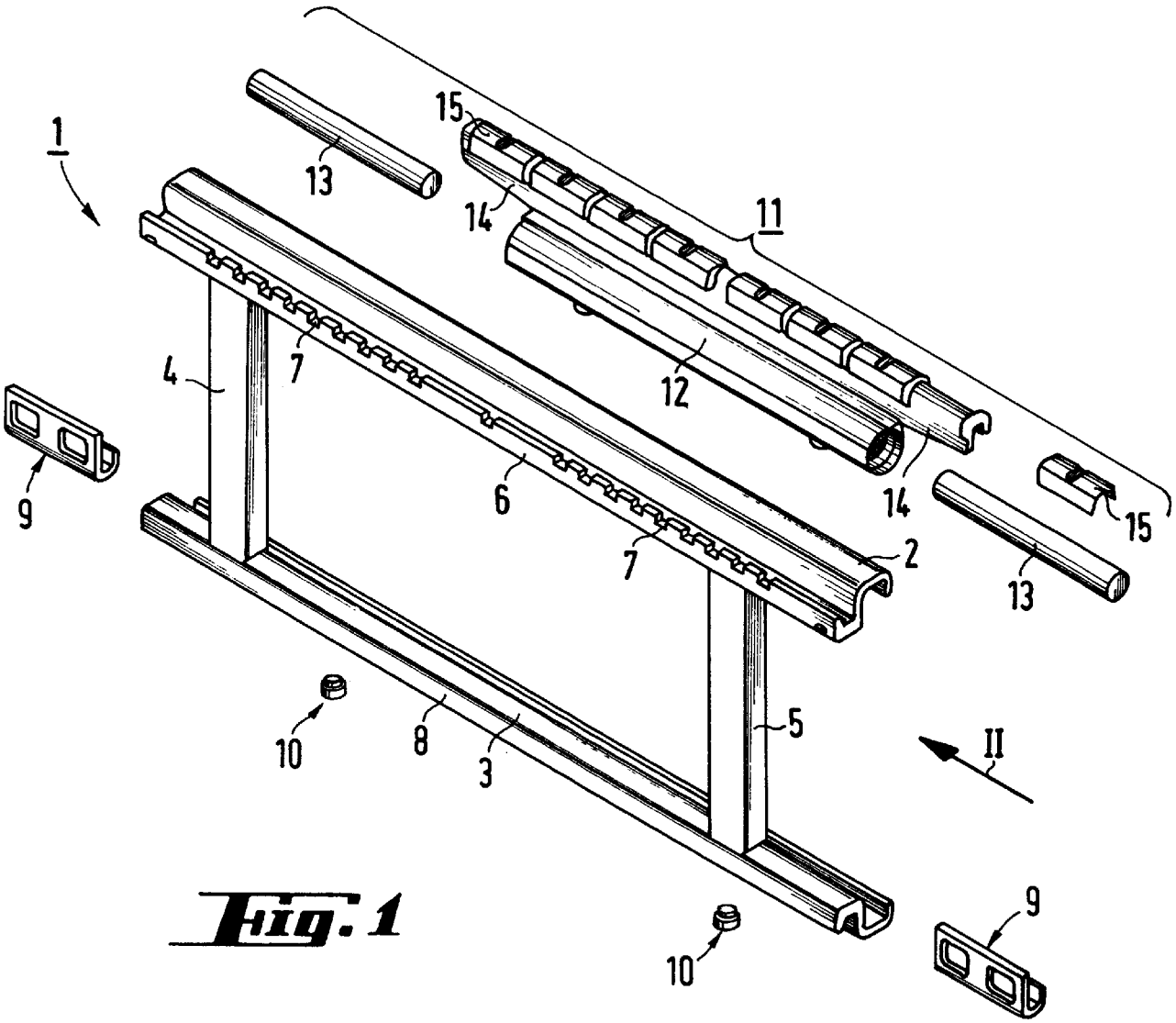
FIG. 1 is an exploded perspective view of the essential parts of a first embodiment of a lateral shift frame without the basic frame of the lift carriage.

Referring to FIG. 1, a lateral shift frame 1 which consists of an upper horizontal frame member 2 and of a lower horizontal frame member 3, both joined fixedly to one another by vertical frame members 4 and S at a distance from their extremities is illustrated. The upper horizontal frame member 2 has an upturned hanger margin 6 which is provided with a series of notches 7 for the insertion of fork tines (not shown). The lower horizontal frame member 3 has a downwardly turned margin 8 which likewise serves for holding the aforesaid fork tines. U-shaped antifriction blocks 9 can be inserted into the lower horizontal frame member 3 from its extremities, and will be further discussed hereinbelow. These antifriction blocks 9 can be locked in the lower horizontal frame member 3 by screws 10 as discussed below.

A hydraulic drive 11 with a cylinder barrel 12 and two plungers 13 pertain to the lateral shift frame 1. The cylinder barrel 12 is formed integral with a hanger member 14 by casting, which will be explained below in connection with FIGS. 12, 13 and 14. The top of the hanger member 14 is occupied at intervals by shell-like antifriction bearings 15 onto which the upper horizontal frame member 2 is placed. Because the cylinder barrel 12 is offset with respect to the hanger member 14, the plungers 13 enter between the vertical frame members 4 and 5 when the shift frame 1 is swung down.

Figure 2:
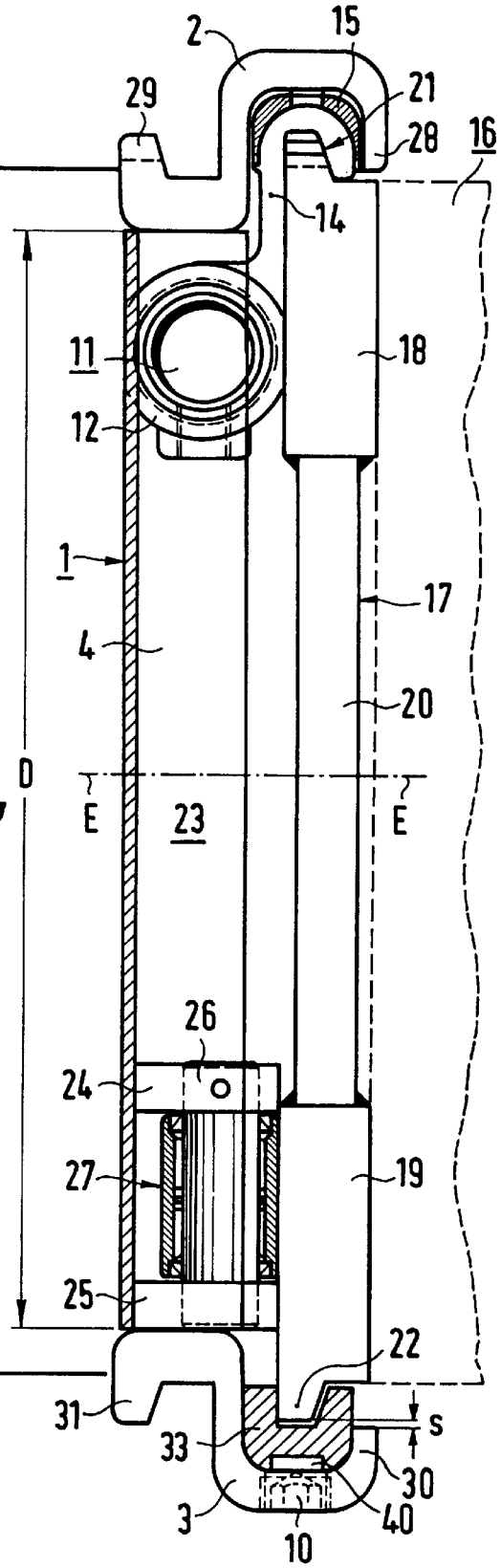
FIG. 2 is a side view, partially in section, of the subject of FIG. 1 seen in the direction of arrow II in FIG. 1, but with the basic frame and in the installed state.

FIG. 2 shows a lift carriage 16 to which a base frame 17 is joined, which likewise consists of an upper horizontal frame member 18 and a lower horizontal frame member 19, which are joined together by two vertical frame members 20. The upper horizontal frame member 18 has an upper hooked margin 21 and the lower horizontal frame member 19 a lower hooked margin 22 onto which, if the lateral shift frame 1 is absent, the backs of fork tines, not shown here, can be placed. In the present embodiment, however, the already described hooked frame member 14 of the cylinder barrel 12 is placed or hung on the upper hooked margin 21, and the antifriction bearings 15 are fitted onto the top side of the hanger member 14. Thus, first of all, before completion of the mounting, the lateral shift frame 1 can be swung over the upper edge 21 and, after assembly is completed, the lateral shift frame 1 is displaceable parallel to the base frame 17 laterally, i.e., perpendicular to the plane of drawing, by means of the hydraulic actuator 11.

Figure 5:
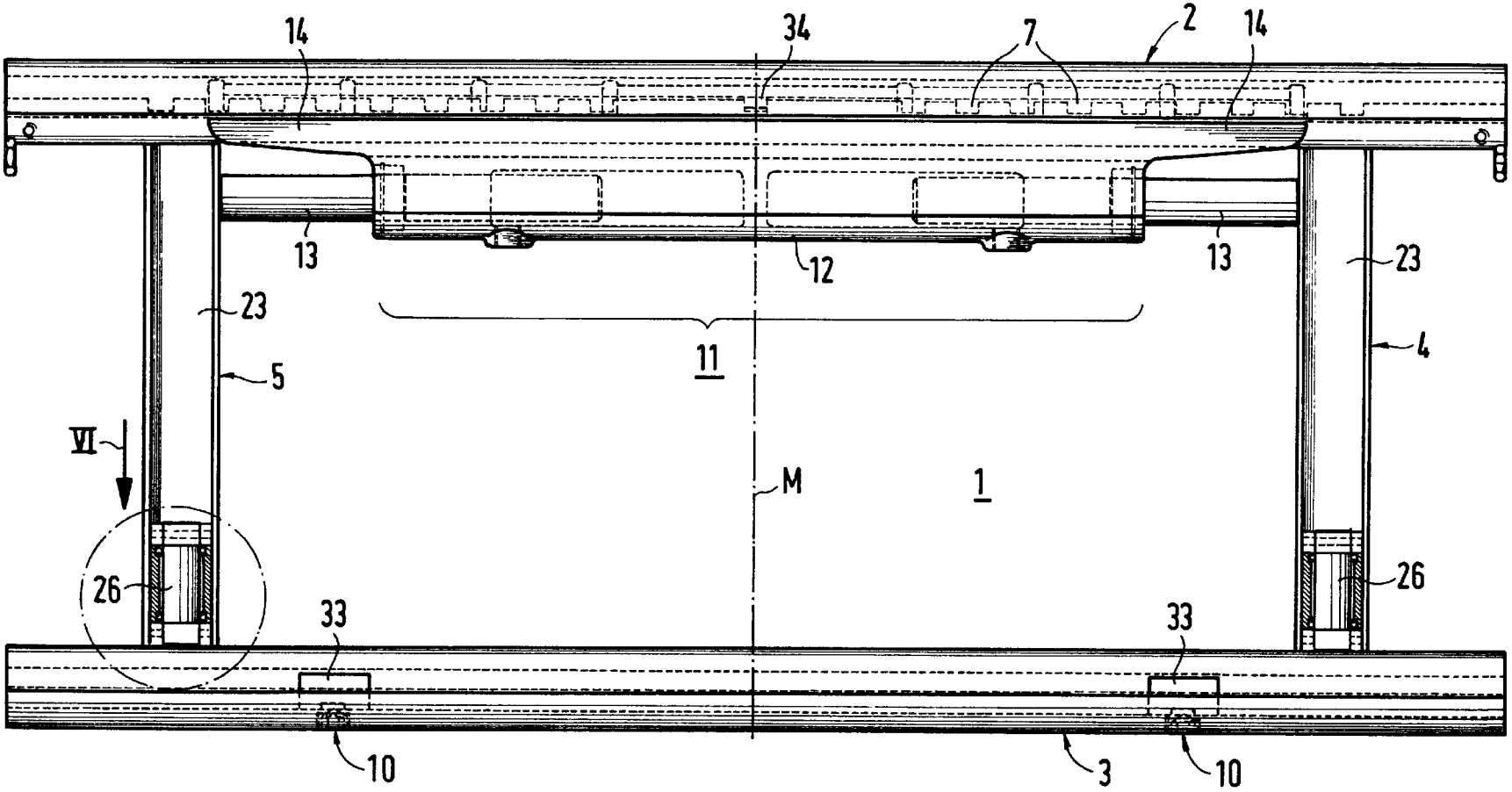
FIG. 5 is a rear view of the lateral shift frame of FIG. 1 as seen by the driver of an industrial truck.
Figure 6:
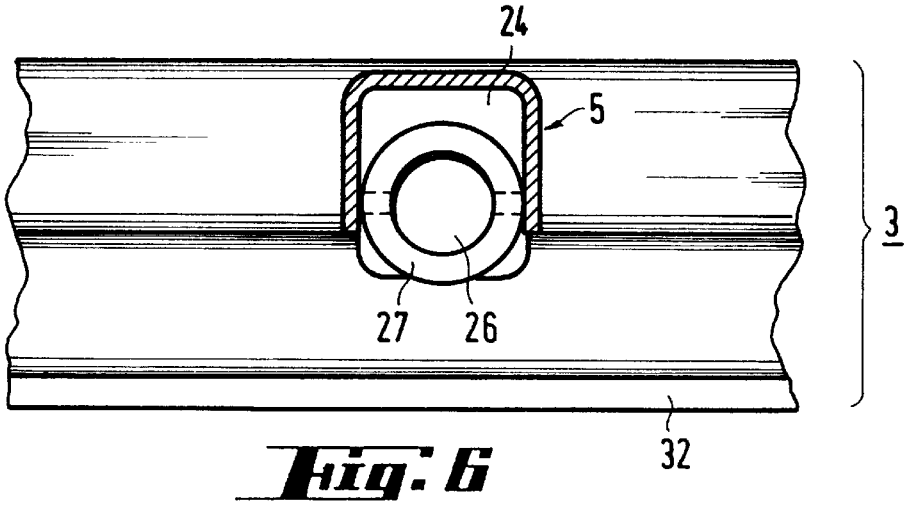
FIG. 6 is an enlarged plan view of the section in circle VI in FIG. 5.

As it is apparent from FIGS. 2, 5 and 6, the vertical frame members 4 and 5 have a U-shaped cross section with its bay 23 open toward the base frame 17 and have at their bottom end, i.e., immediately above the lower horizontal frame member 3, two bearing blocks 24 and 25 consisting of plastic and loosely inserted, which are joined together by a vertical shaft 26. This shaft 26 bears a roller 27 which rolls on the lower horizontal member 19 of the base frame 17 when the lateral shift frame 1 is moved horizontally.

Figure 3:
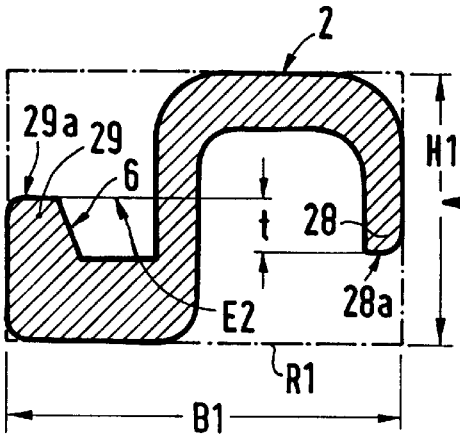
FIG. 3 is a cross section of the upper horizontal frame member of the lateral shift frame on an enlarged scale in a rectangle R1.
Figure 4:
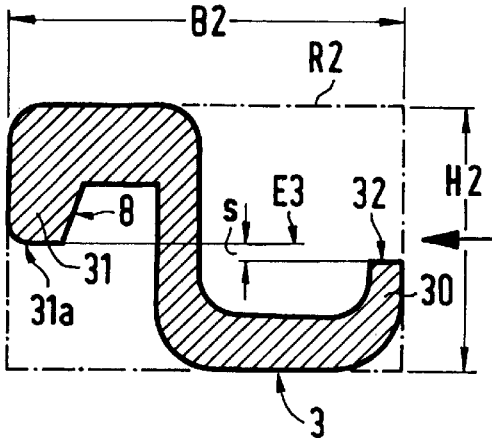
FIG. 4 is an enlarged cross section of the lower horizontal frame member of the lateral shift frame in a rectangle R2.

As shown in FIGS. 2, 3, and 4, the two horizontal frame members 2 and 3 have a roughly S-shaped cross section and are at least partially in mirror-image symmetry with respect to a horizontal central plane E—E of the lateral shift frame 1. This is in no way changed by the fact that the lower horizontal frame member 3 in FIG. 4 is represented in FIG. 3 in mirror-image relationship to the upper horizontal frame member 2 in FIG. 3, because the cross-sectional view is also true for the direction of view from the opposite side.

The upper horizontal frame member 2 has a first cross-sectional extremity 28 to fit around the upper edge 21 plus the hanger member 14 and the antifriction bearings 15, plus a second cross-sectional extremity 29 which forms the already described upper edge 6 for attaching the fork tines. The cross section of the upper horizontal flame member represented in FIG. 3 is circumscribed by a rectangle R1 which has a height H1 and a width B1, H1 being smaller than B1.

In FIG. 3, a plane E2 is indicated which runs substantially horizontally and passes through the upper edge 29*a* of the upper cross sectional extremity 29 in the assembled state of the side shifter. The bottom edge 28*a* of the lower cross sectional extremity 28 lower than this plane E2 by an amount "t" of several millimeters, so that the hanger member 14 and the antifriction bearings 15 are reliably encompassed.

Vice-versa, the lower horizontal frame member 3 in FIG. 4 has a first upturned cross-sectional extremity 30 and a second downwardly turned cross-sectional extremity 31 which forms the already described lower hooking edge 8. The edges 6 and 8 serve for mounting the backs of the forks (not shown). As represented in FIG. 4, the cross section of the lower horizontal frame member 3 is circumscribed by a rectangle R2 whose height H2 is less than its width B2.

According to FIG. 4, the upper edge 32 of the upturned cross-sectional extremity 30 of the lower horizontal frame member 3 lies below, by an amount "s" of a few millimeters, a horizontal plane E3 running parallel to plane E2 in FIG. 3 and through the lower edge 31*a* of the downturned cross-sectional extremity 31 of the same horizontal frame member 3.

Through the length of the two vertical frame members 4 and 5 the two horizontal frame members 2 and 3 are at a precisely established distance D which is important in connection with the following explanation: The upper edge 32 of the cross-sectional extremity 30 is in such a position in space with respect to the lower edge 22 that the cross-sectional extremity 30 moves, during the swinging movement described above, in back of this lower edge 22, which is represented in FIG. 2 at the bottom. This vertical distance is defined by the dimension "s" which amounts to a few millimeters. To hold the lateral shift frame 1 against the base frame 17, a channel-shaped antifriction block 33 is inserted from the ends of the horizontal frame member 2 between the lower horizontal frame member 3 and the lower edge 22, and held in place by one of the previously described screws 10. By turning the screws 10 in and out, the free play between the antifriction block 33 and the lower edge 22 can be adjusted, and the antifriction block 33 is secured against slippage.

The lateral shift system of FIG. 1 is shown assembled in FIG. 5, although the base frame 17 is omitted. The hanger member 14 of the cylinder barrel 12 has in its bay a downwardly extending projection 34 which is engaged in a complementary recess in the upper edge 21 of the base frame 17, so that the hydraulic actuator 11 itself is secured against transverse movement. Depending on how the two plungers 13 are operated, the lateral shift frame 1 will be shifted leftward or rightward from a central plane M in order to compensate for the maneuvering or positioning errors earlier described. The range of movement is defined by the free length of the plungers 13.

Figure 7:
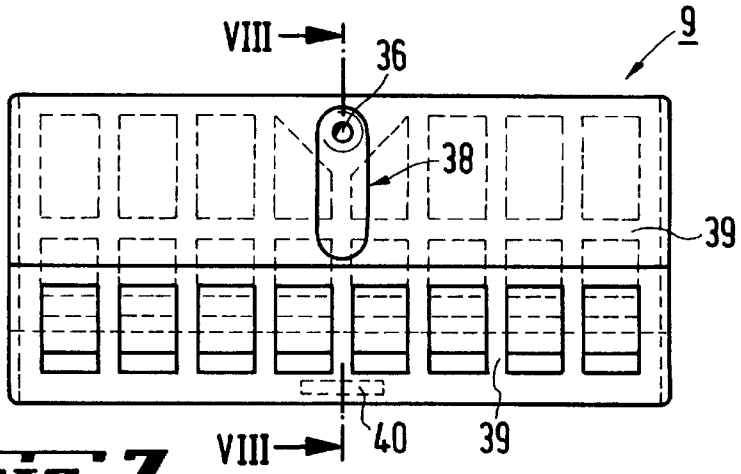
FIG. 7 is a rear view of an antifriction block in accord with FIGS. 8 to 11, seen in the direction of arrow VII in FIG. 8.
Figure 8:
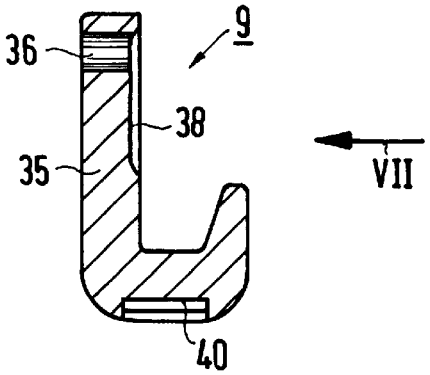
FIG. 8 is a section along line VIII—VIII through the slide block in FIG. 7.
Figure 9:
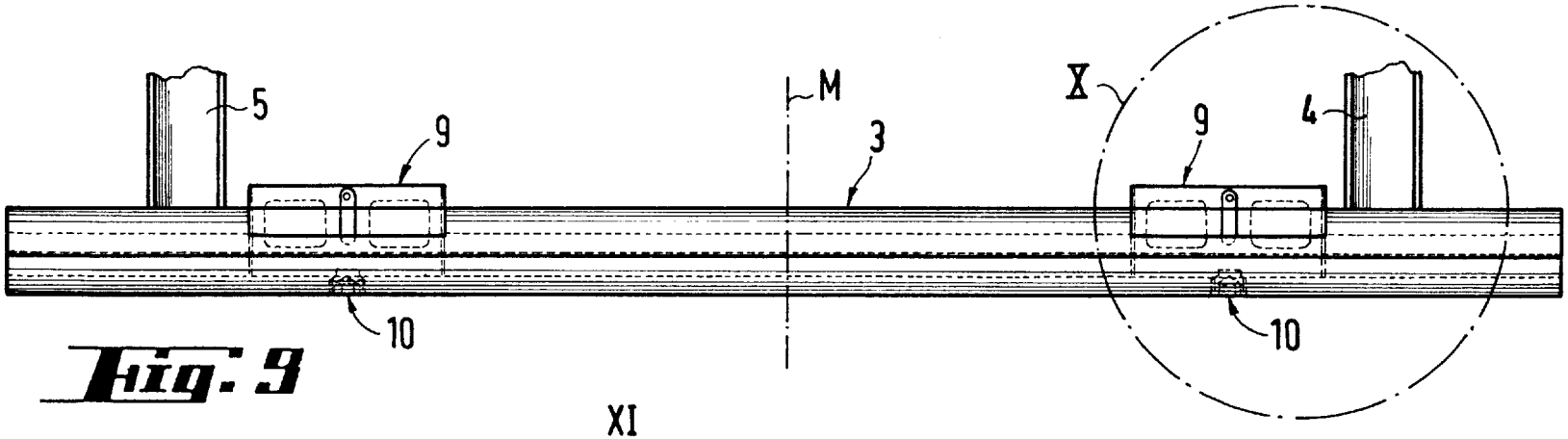
FIG. 9 is a rear view of the bottom part of a second embodiment of the lateral shift frame similar to FIG. 5.
Figure 10:
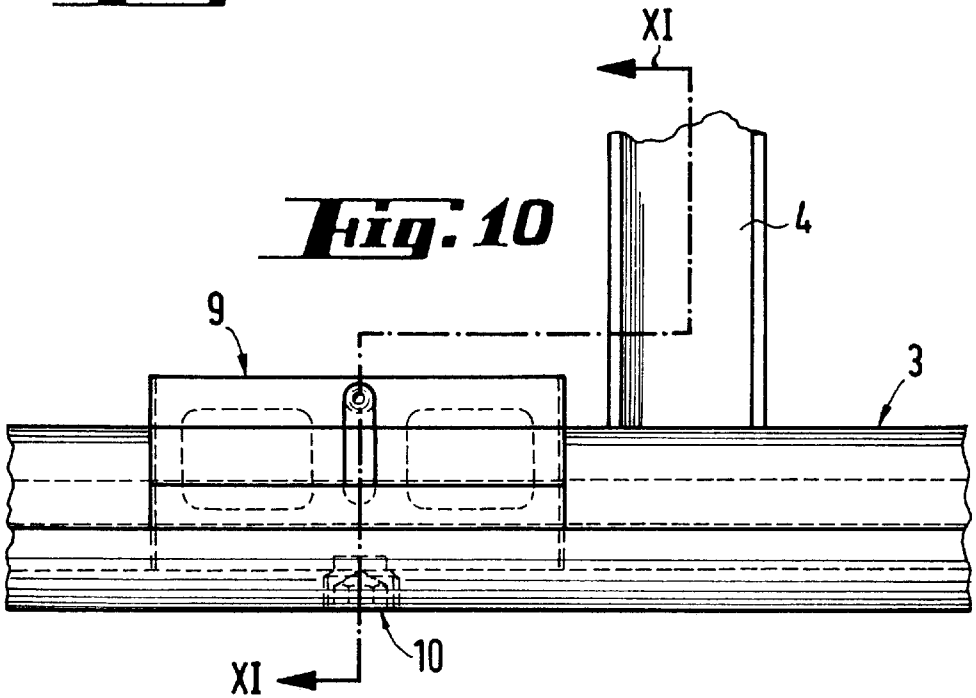
FIG. 10 is an enlarged detail of the circle X in FIG. 9.
Figure 11:
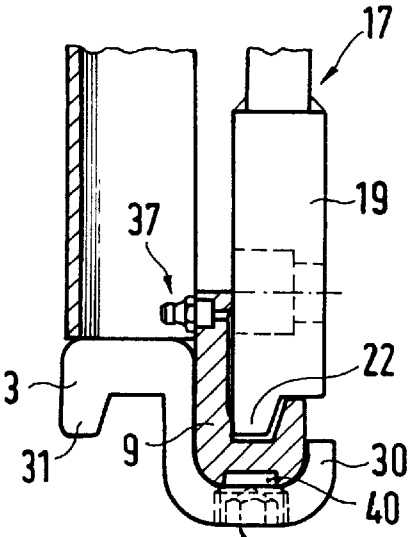
FIG. 11 is a section along line XI—XI through the subject of FIG. 10.

FIGS. 7 and 8 show one of the antifriction blocks 9 from FIG. 1; the two limbs of the channel-shaped cross section are of different height. The higher limb 35, which is on the pressure side, has a tap 36 for a grease fitting 37 (FIG. 11) as well as a grease pocket 38. To save material the outer sides of the antifriction block 15 can be provided with recesses between ribs 39. The use of antifriction blocks 9 according to FIGS. 1, 7 and 8 is expedient whenever the rollers 27 in FIGS. 2 and 5 are not used. This alternate embodiment will be explained with the aid of FIGS. 9, 10 and 11. A cylindrical recess 40 in the yoke of the antifriction blocks 15 and 33 serves for the insertion of a complementary prolongation of the locking and adjusting screws 10. The antifriction blocks have a decidedly greater friction surface area than antifriction blocks 33, so that for this reason the rollers 27 can be omitted. The final assembly of the embodiment in FIGS. 9, 10 and 11 is performed in the manner described earlier.

Figure 12:
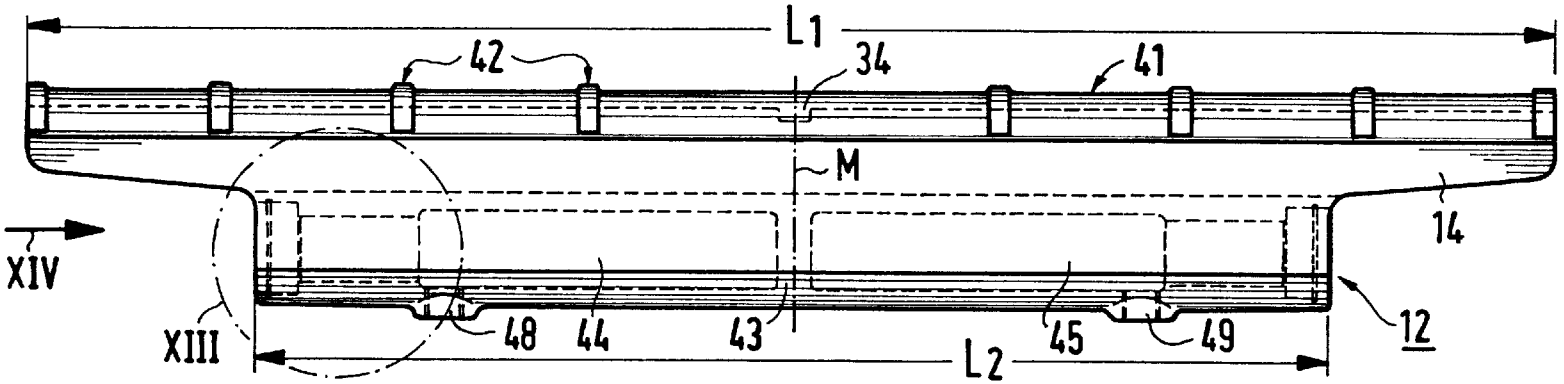
FIG. 12 is a rear view of a hydraulic cylinder unit of FIG. 1 as seen in the direction of arrow XII in FIG. 14.
Figure 14:
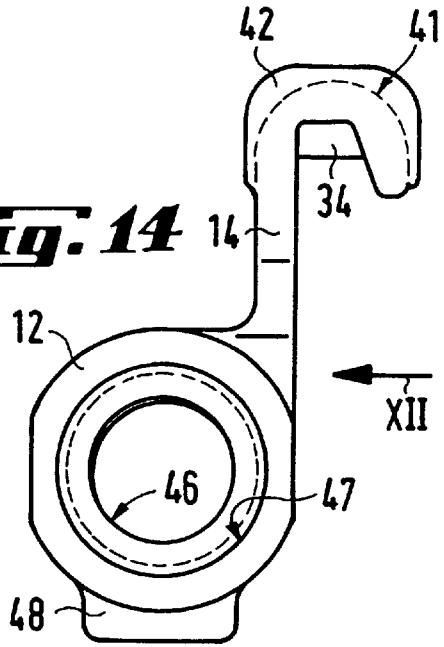
FIG. 14 is a side view of the subject of FIGS. 12 and 13 in the direction of the arrows XIV.
Figure 13:
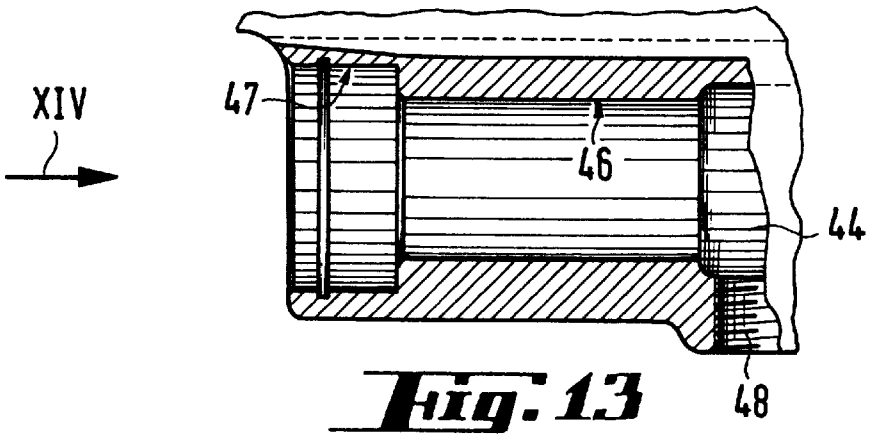
FIG. 13 is an enlarged section, partially cut away, contained in the circle XIII in FIG. 12.

In FIGS. 12, 13, and 14, details of the cylinder barrel 12 of FIGS. 1, 2 and 5 are shown as follows: The hanger 14 has a definitely greater length L1 than the length L2 of the cylinder barrel 12 itself, the length L1 corresponding approximately to the distance between the vertical frame members 4 and S, as shown in FIG. 5. Thus the upper horizontal frame member 2 is supported on almost its entire length, and the unit composed of cylinder barrel 12 and hook edge 14 accounts for a great part of this support. The hanger 14 is provided along its convexly curved upper side 41 with ribs 42 between which the shell-like antifriction blocks 15 of FIG. 1 are inserted. The actual cylinder barrel 12 has two bores 44 and 45 separated by a wall 43, which have been formed by casting except for a machined guiding section 46 and a gasket seat 47 (FIG. 13). In this manner a considerable amount of machining is avoided. Connectors 48 and 49 serve to enable hydraulic lines, not shown here, to be screwed in, by which the movement of the plungers 13 is produced. FIG. 14 also shows that the hanger 14 has in its center the projection 34 already described, by which the cylinder barrel 12 is locked to the base frame 17.

Figure 15:
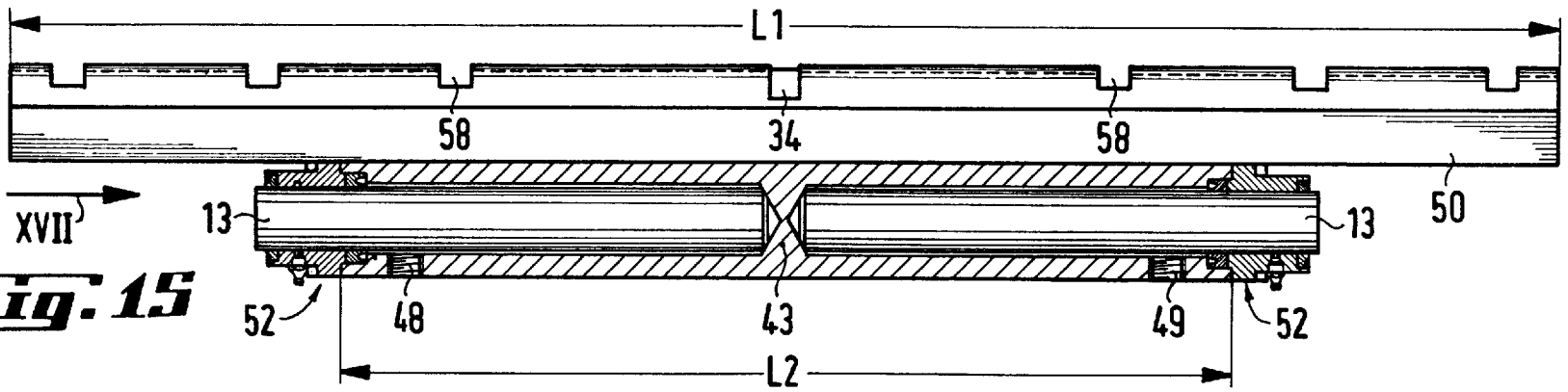
FIG. 15 is a partially cut-away rear view of a hydraulic cylinder unit similar to FIG. 12, composed of a block and a hooking frame member.
Figure 17:
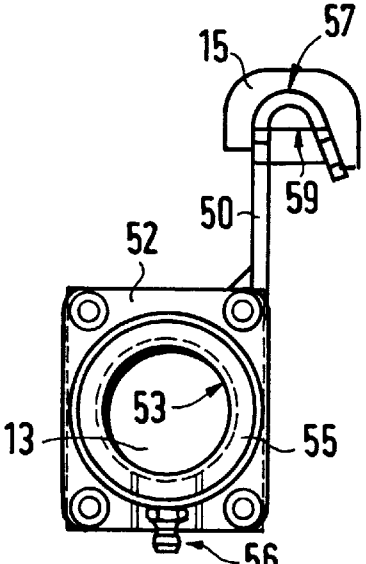
FIG. 17 is a side view of the subject of FIGS. 15 and 16, seen in the direction of arrow XVII in FIG. 15.
Figure 16:
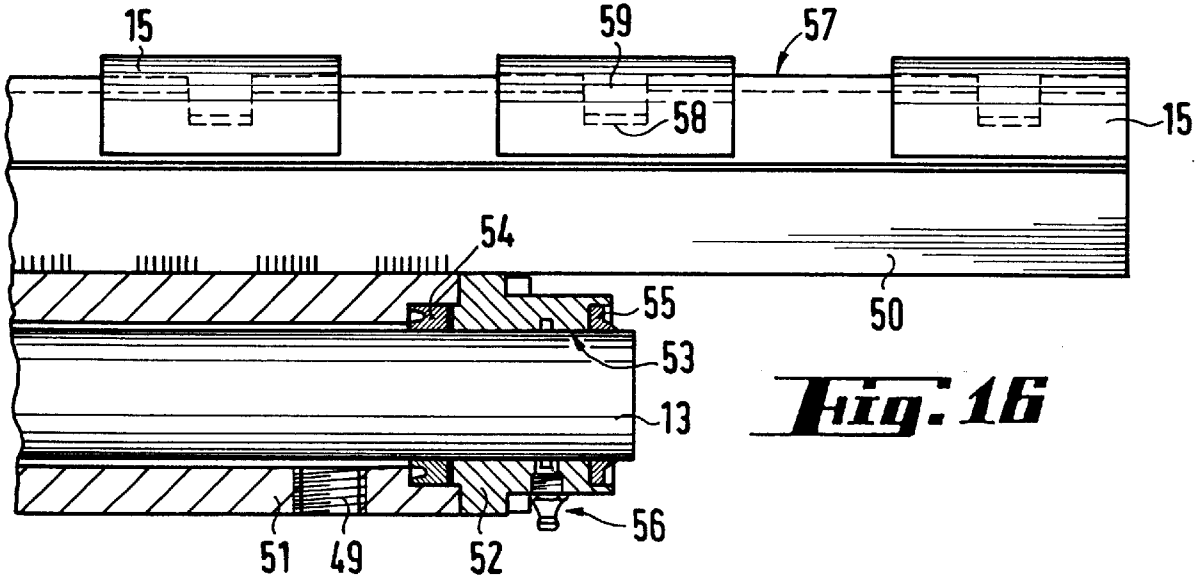
FIG. 16 shows on an enlarged scale the right-hand portion of FIG. 15 with superimposed shell-shaped sliding bodies.

FIGS. 15, 16, and 17 show an alternate embodiment of the subject matter of FIGS. 12, 13 and 14. In this case the hook-shaped portion 50 is bent from sheet steel and welded to a cylinder barrel 51 which is made from a steel block of parallelepiped shape. The bores of the cylinder barrel 51, which are separated by the wall 43, were in this case made by boring. As it is shown in FIG. 16, guiding sleeves 52 on both ends of the cylinder barrel 51 are provided with bores 53 to guide the plungers 13. At the inner end of each guiding sleeve 52 there is a lipped gasket 54, and at the outer end a wiper ring 55. Between the lipped gasket 54 and the wiper ring 55 a grease fitting 56 is provided.

The hooked edge 50 is provided along its convexly curved top side 57 with recesses 58 into which prolongations 59 of shell shaped antifriction bearings 15 are inserted, on which, in this case too, the upper horizontal member 2 of the lateral shift frame 1 is displaceable.

In the last-described embodiment, the structural junction (by welding) of the hooked edge 50 and cylinder barrel 51 results in an extraordinarily rigid component which has the same length ratios as the individual parts of the casting, so that in this case too the upper horizontal frame member is supported most effectively on a length which corresponds to the distance between the vertical frame members 4 and 5 in the embodiment.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

What is claimed is:

1. A lateral shifting system for a floor transport vehicle, comprising:

a lift carriage;

a base frame joined to the lift carriage, said base frame having an upper and a lower mounting rail;

a first hooked frame member on the upper rail secured against transverse shifting;

a hydraulic drive attached to said first hooked frame member;

a lateral shift frame having an upper horizontal frame member which has a substantially S-shaped cross section and can be turned back upon the said first hooked frame member against a direction of travel of the vehicle and which can be shifted by the hydraulic drive across the direction of travel, said shift frame having a lower horizontal frame member which has a substantially S-shaped cross section which is at least partially in mirror-image symmetry to the upper horizontal frame member with respect to a horizontal central plane of the lateral shift frame and joined to the lower mounting rail so as to be displaceable across the direction of travel, said lower horizontal frame member of the lateral shift frame having attached thereto an upwardly directed cross-sectional extremity with an upper edge which is moveable behind a lower edge of the lower mounting rail of said base frame, said lower mounting rail having lateral ends;

antifriction means being removable and having a basically U-shaped configuration and operatively engaged with the lower horizontal frame member whereby the shift frame can be swung in and out about the upper horizontal frame member to and from said base frame in absence of the antifriction means and is locked against the latter in presence of the antifriction means to restrain the lateral shift frame from swinging movement.

2. The lateral shifting system of claim 1 wherein the antifriction means are U-shaped blocks inserted in the lateral ends of the lower mounting rail, said blocks restraining swinging movement of the lateral shift frame about its upper horizontal frame member in the direction of travel, between the lower edge of the base frame and the lower horizontal frame member of the lateral shift frame.

3. The lateral shifting system of claim 2 further comprising adjusting screws positioned in the lower horizontal frame member beneath the U-shaped antifriction blocks for the adjustment of free play between the antifriction blocks and the lower edge of the base frame of the lift carriage.

4. The lateral shifting system of claim 3 wherein the blocks are bearings.

5. The lateral shifting system of claim 1 wherein the lateral shift frame comprises at least two vertical frame members between its horizontal frame members.

6. The lateral shifting system of claim 5 wherein the hydraulic driver has two plungers drivable in opposite directions, the outer ends of which engage the vertical frame members at inside surfaces thereof.

7. The lateral shifting system of claim 5 wherein the vertical members of the lateral shift frame each have a U-shaped cross section.

8. The lateral shifting system of claim 7 wherein each U-shaped cross-section has a bay turned toward the base frame of the lift carriage and a roller disposed in the bay at a bottom end thereof.

9. The lateral shifting system of claim 8 wherein the roller is adapted to roll horizontally on the lower part of the base frame.

10. The lateral shifting system of claim 1 wherein at least one of the horizontal frame members of the lateral shift frame has a substantially S-shaped cross section and is arranged at least partially in mirror-image symmetry with a horizontal central plane (E—E) of the lateral shift frame.

11. The lateral shifting system of claim 10 wherein the S-shaped cross section is arranged such that the cross-sectional extremities are directed toward one another and engage the edges of the base frame in a horizontally displaceable manner.

12. The lateral shifting system of claim 10, wherein the S-shaped cross section is arranged such that the cross-sectional extremities are directed away from one another and form edges for attaching fork tines.

13. The lateral shifting system of claim 1 wherein the upper edge of the upturned cross-sectional extremity of the lower horizontal frame member is disposed below a horizontal plane (E3) constituted by the lower edge of the downwardly turned cross-sectional extremity of the same horizontal frame member.

14. The lateral shifting system of claim 1 wherein the cross section of the horizontal frame members are respectively circumscribed by a rectangle (R1, R2) whose height (H1, H2) is less than its width (H1, B2).

15. The lateral shifting system of claim 1 wherein said first hooked frame member is formed of bent sheet steel.

16. The lateral shifting system of claim 15 wherein the hydraulic driver has a cylinder barrel bored from both ends to a dividing wall and is rigidly affixed to said first hooked frame member.

17. The lateral shifting system of claim 16 wherein said first hooked frame member and the cylinder barrel of the hydraulic driver together form an integral casting having recesses extending to the dividing wall except for a machined guiding section and a gasket seat.

18. The lateral shifting system of claim 17 wherein said first hooked frame member has a convexly curved top side with ribs between which shell-shaped antifriction bearings are inserted, on which the upper horizontal member of the lateral shift frame is displaceable.

19. The lateral shifting system of claim 17 wherein said integral casting does not consist of a machined guiding section and a gasket seat.

20. The lateral shifting system of claim 15 wherein said first hooked frame member has a convexly curved top side with recesses into which prolongations of shell-shaped antifriction bearings are inserted, on which the upper horizontal member of the lateral shift frame can be displaced.

21. The lateral shifting system of claim 1 wherein the floor transport vehicle is a fork lift truck.

* * * * *

UNITED STATES PATENT AND TRADEMARK OFFICE

CERTIFICATE OF CORRECTION

PATENT NO. : 5,913,654
DATED : June 22, 1999
INVENTOR(S) : Otmar Kaup

It is certified that error appears in the above-identified patent and that said Letters Patent is hereby corrected as shown below:

On the title page: Item [30] Foreign Appl. Priority Data, change

"196 02 055" to read as - - 197 02 055.7-22 - -.

In the cover page, under the section titled Foreign Patent Document, change "10/1985" to read as - - 10/1978 - -.

In the cover page, under the section titled US Patent Documents, change "2/1958" to read as - - 2/1955 - -.

In the cover page, under the section titled Abstract, change "upturned" to read as - - upturned - -.

In column 1, line 50, change the word "flame" to read as - - frame - -.

In column 4, line 43, insert a period after the word "metal" to read as - - metal. - -.

In column 5, line 39, change the letter "S" to - - 5 - -.

In column 7, line 50, change the letter "S" to - - 5 - -.

In column 10, line 14, change "(H1, B2)" to - - (B1, B2) - -.

Signed and Sealed this

Thirtieth Day of January, 2001

*Attest:*

Q. TODD DICKINSON

*Attesting Officer*

*Director of Patents and Trademarks*